US009441494B2

(12) United States Patent
Marlin et al.

(10) Patent No.: US 9,441,494 B2
(45) Date of Patent: Sep. 13, 2016

(54) TURBOMACHINE ROTOR WITH A MEANS FOR AXIAL RETENTION OF THE BLADES

(75) Inventors: Francois Marie Paul Marlin, Villiers sous Grez (FR); Frederic Imbourg, Orly (FR); Didier Queant, Saint Fargeau Ponthierry (FR)

(73) Assignee: SNECMA, Paris (FR)

( * ) Notice: Subject to any disclaimer, the term of this patent is extended or adjusted under 35 U.S.C. 154(b) by 377 days.

(21) Appl. No.: 14/115,513

(22) PCT Filed: May 4, 2012

(86) PCT No.: PCT/FR2012/051004

§ 371 (c)(1),
(2), (4) Date: Nov. 4, 2013

(87) PCT Pub. No.: WO2012/150425

PCT Pub. Date: Nov. 8, 2012

(65) Prior Publication Data

US 2014/0072437 A1 Mar. 13, 2014

(30) Foreign Application Priority Data

May 4, 2011 (FR) ..... 11 53839

(51) Int. Cl.
*F01D 5/30* (2006.01)
*F01D 5/32* (2006.01)
(Continued)

(52) U.S. Cl.
CPC ..... *F01D 5/3038* (2013.01); *F01D 5/323* (2013.01); *F01D 11/008* (2013.01); *F04D 29/322* (2013.01); *F05D 2220/36* (2013.01)

(58) Field of Classification Search
CPC .... F01D 5/323; F01D 5/3038; F01D 11/008; F04D 29/322
USPC ..... 416/220 R, 221
See application file for complete search history.

(56) References Cited

U.S. PATENT DOCUMENTS 4,478,554 A * 10/1984 Surdi ..... F01D 5/323 416/220 R
5,049,035 A * 9/1991 Marlin ..... F01D 11/008 416/193 A (Continued)

FOREIGN PATENT DOCUMENTS

EP 1 748 154 1/2007
EP 1 970 537 9/2008

(Continued)

OTHER PUBLICATIONS

International Search Report Issued Aug. 24, 2012 in PCT/FR12/051004 Filed May 4, 2012.

*Primary Examiner* — Nathaniel Wiehe
*Assistant Examiner* — Woody A Lee, Jr.
(74) *Attorney, Agent, or Firm* — Oblon, McClelland, Maier & Neustadt, L.L.P.

(57) ABSTRACT

A rotor of a turbomachine, such as a multi-flow turbojet engine fan, has a disc including, on the rim thereof, substantially axial slots with a dovetailed cross-section, and blades mounted individually in the slots, an axial wedge positioned between the root of the blades and the bottom of the slots, and a transverse lock providing upstream axial immobilization of the blades in the slot thereof. The lock is guided in radial notches formed in the flanks of the slots and radially supported against the wedge. The axial wedge is immobilised in the upstream direction, butting up against a transverse annular component secured to the disc.

9 Claims, 4 Drawing Sheets

(51) Int. Cl.
*F01D 11/00* (2006.01)
*F04D 29/32* (2006.01)

(56) References Cited

U.S. PATENT DOCUMENTS 5,259,728 A 11/1993 Szpunar et al.
5,282,720 A * 2/1994 Szpunar ..... F01D 5/323 416/220 R
6,457,942 B1 10/2002 Forrester
2008/0226458 A1* 9/2008 Pierrot ..... F01D 5/323 416/220 R
2009/0226321 A1 9/2009 Buisson et al.

FOREIGN PATENT DOCUMENTS

FR 2 345 605 10/1977
FR 2 492 906 4/1982
FR 2 690 947 11/1993
FR 2 814 495 3/2002

* cited by examiner

TURBOMACHINE ROTOR WITH A MEANS FOR AXIAL RETENTION OF THE BLADES

TECHNICAL FIELD OF THE INVENTION

The present invention relates to the field of turbomachines, more particularly that of multiflow turbofan engines with the fan at the front and is concerned with the axial locking of the blades housed in axial pockets or grooves on the rim of a rotor disk. It is essentially concerned with the locking of the fan blades in their housing on the fan disk.

PRIOR ART

A multiflow turbojet engine comprises a gas turbine engine driving a fan generally situated at the front of the engine. A fan conventionally comprises a rotor disk provided with a plurality of radial fan blades spaced apart from one another circumferentially and fixed in individual pockets formed on its rim. The pockets are oriented substantially axially and have a dovetail cross section. Their shape complements that of the blade roots to hold the latter in place when the blades are subjected to the centrifugal forces as the disk rotates. The blades are fitted individually by introducing them axially into the pockets. They are wedged radially by means of an axial wedge which is slipped in-between the bottom of the pocket and the root of the blade. They are held axially in the downstream direction by an abutment generally formed of the drum of the low pressure or boost rotor which is secured to the fan disk downstream and are held axially in the upstream direction by means of a lock. Upstream and downstream are defined with reference to the direction in which the gaseous stream flows through the engine.

Solutions for the axial retention of the blade in its housing when subjected to the aerodynamic forces which comprise an axial component that therefore tends to cause it to slide with respect to the pocket have been proposed. For example, in document FR 2 345 605 filed in the name of the applicant company, the lock is formed of a U-shaped component positioned in a radial plane perpendicular to the axial wedge and is itself held in radial notches formed both in the root of the blade and in the side walls of the pocket.

In document FR 2 690 947, the axial blade retention device is formed of an axial wedge positioned under the root of the blade in the bottom of the pocket and of a lock perpendicular to the axial wedge and against which the blade root comes into axial abutment upstream. The lock is placed in radial notches formed in the side walls of the teeth of the disk—the part of the rim of the disk between two adjacent pockets being referred to as a tooth. The lock and the wedge are joined together by a screw which passes radially through a first lug extending the axial wedge in the upstream direction and a second lug secured to the lock, at right angles to the latter. It will be noted that, according to that document, a spacer piece is interposed between the lock and the root of the blade in order to damp axial loads resulting from fan blade impact damage caused by the ingestion of a foreign object for example. The spacer piece is made of a deformable material, such as a honeycomb, in order to absorb the energy of the impact.

In a fan rotor, the blades comprise an airfoil and a root for mounting on the disk but have no inbuilt platform. Inter-blade platforms are added in-between the blades to ensure the continuity of the radially interior surface of the air flow path through the rotor. These inter-blade platforms, when made of metal, are fixed to the teeth of the rim of the disk by axial pegs that pass through two axial eyelets secured one of them to the tooth and the other to the inter-blade platform.

The fan blades, which have a long chord and are made of a composite material, with which certain engines are equipped are immobilized by axial wedges arranged under their bulb-shaped root, which are likewise made of a composite material. According to the prior art, for this kind of embodiment, the axial wedges are immobilized by a screwed connection to the lock for axial retention of the blade in the upstream direction. This connection takes up a significant amount of space between the upstream edge of the teeth of the disk, as can be seen in FIG. 1. The bulkiness of the screwed connection between the wedge and the lock therefore means that the rear shell ring of the rotor nose cowl has to avoid the area. The nose cowl is the piece of streamlining that forms the upstream exterior surface of the fan rotor.

As FIG. 1 shows, the overhang of the wedge in relation to the upstream face of the lock presents no particular problem and is acceptable because there is space for it in the downstream volume formed by the cowl rear shell ring.

This solution does, however, present certain disadvantages:

When the inter-blade platforms are of the composite box section type, it is necessary to hold them in place using a front shell ring which is separate from the cowl mentioned hereinabove. This is because the rear part of such cowl does not have the mechanical strength to be able to perform this retaining function. Such a shell ring has therefore to be scalloped and to be open enough that it does not interfere with axial wedges and allows them to pass.

Because the axial wedge is made of a composite material like the fan blades, a metal head made of light alloy has to be bonded to it to provide a screwed connection with the lock. The wedge is therefore more difficult to manufacture.

The wedge/lock assembly is expensive to manufacture.

SUMMARY OF THE INVENTION

One object of the invention is to create a fan rotor that does not have the disadvantages of the above solution.

According to the invention, the turbofan rotor comprising a disk with a rim and substantially axial pockets of dovetail section on the rim, and blades mounted individually in the pockets, an axial wedge being arranged between the root of the blades and the bottom of the pockets and a transverse lock providing axial blockage in the upstream direction of the blades in their pocket, the transverse lock being guided in radial notches formed in the side walls of the pocket and bearing radially against the wedge, is characterized in that the axial wedge is immobilized in the upstream direction by being in abutment against a transverse annular component secured to the disk.

The solution of the invention therefore consists in eliminating the screw-nut type of connection between the axial wedge and the lock.

This solution offers the advantage of a simplified structure while at the same time meeting the technical specifications for the axial wedge and for the lock, namely:

- The axial wedges can be replaced in line.
- It facilitates fitting operations. The axial wedges can be fitted using a mallet and extracted using inertia tooling.
- The part of the axial wedge that is situated under the bulb of the blade is unchanged compared with the axial wedge in service with the earlier solution, the geometry being connected to the bulb of the blade.

The axial wedge positions the blade as it did in the prior solution.

The axial wedge radially positions the lock when the engine is stopped.

The axial abutment of the wedge is ensured in the downstream direction by the lock or by the drum of the low-pressure compressor, as in the prior solution.

If the rotor comprises composite box section inter-blade platforms, the solution is compatible with the presence of an upstream shell ring made of titanium to hold them in place.

Thus, according to a first embodiment, when the rotor comprises inter-blade platforms that are held in place by means of an upstream shell ring for the retention of the inter-blade platforms, this shell ring forms said transverse annular component against which the axial wedges can abut.

Advantageously, the axial wedge comprises a radial tab forming an axial abutment against said upstream shell ring; more specifically, the lock comprises an axial tab forming an axial abutment for the axial wedge.

According to another feature, the lock comprises a spacer piece made of a material that can be deformed by compression between the lock and the blade root.

According to another embodiment, with the rotor comprising inter-blade platforms held in position by means of an inter-blade platform retaining shell ring, said annular component for immobilizing the axial wedges forms a protective cone for the rotor in the upstream direction. In this embodiment, the platform retention shell ring comprises a radial flange for fixing to the rotor disk, the flange being scalloped to form openings through which the axial wedges bear axially against the transverse annular component.

According to one feature, the axial wedges comprise an axial lug with a radial orifice by means of which the axial wedges can be extracted from their pocket.

The invention also relates to the front-fan turbofan engine comprising a fan rotor thus defined.

BRIEF DESCRIPTION OF THE FIGURES

Further features and advantages will become apparent from the detailed description which follows of some non-limiting embodiments made with reference to the attached drawings in which.

DETAILED DESCRIPTION OF THE INVENTION

Figure 1:
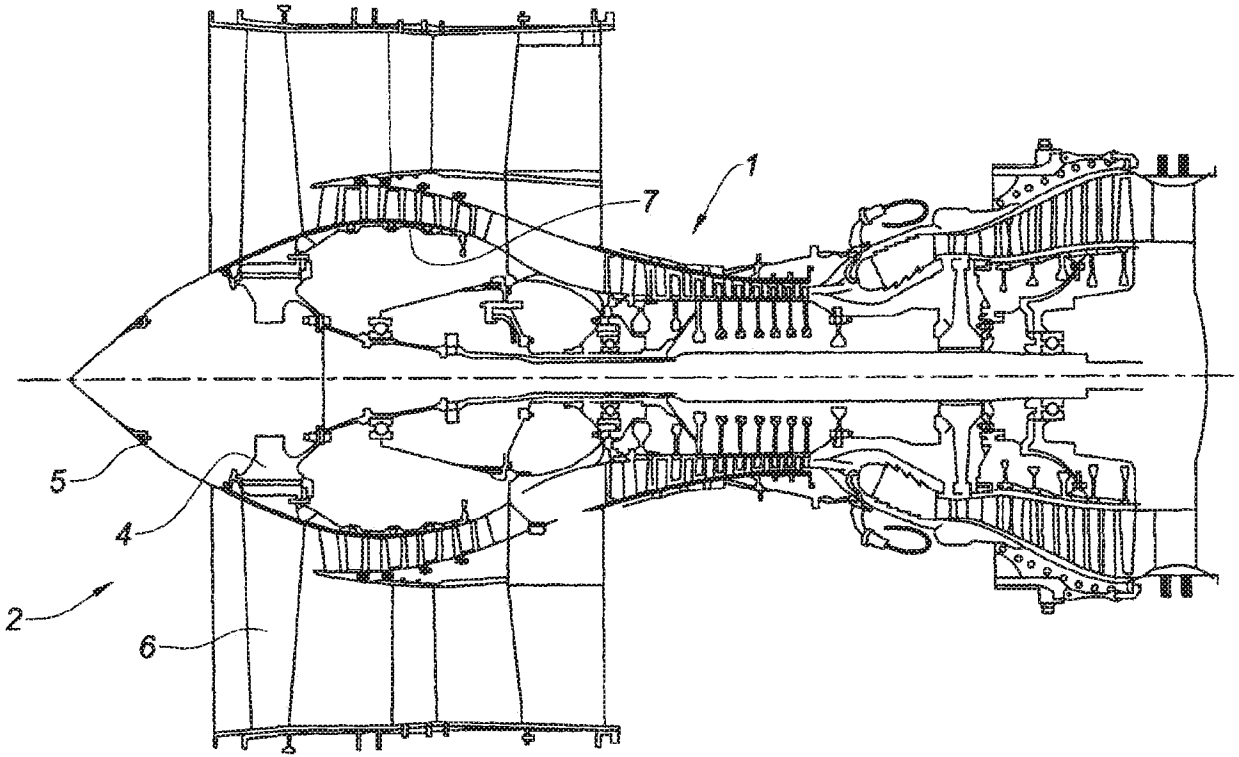
Fig. 1 Background Art
FIG. 1 is an axial cross section of a twin flow (bypass) turbojet engine.

The turbojet engine of FIG. 1 is a twin flow (bypass) engine with a front fan 2 comprising a fan disk 4 on which there are fan blades 6 retained by their roots in pockets formed in the rim. The disk is mounted with overhang on the low-pressure shaft which likewise supports the drum 7 of the low-pressure or boost compressor immediately downstream of the disk and to which it is secured. A component 5 of conical overall shape is fixed on the upstream side to the fan disk; this component has an essentially aerodynamic function of guiding the stream of air toward the inlet of the engine.

Figure 2:
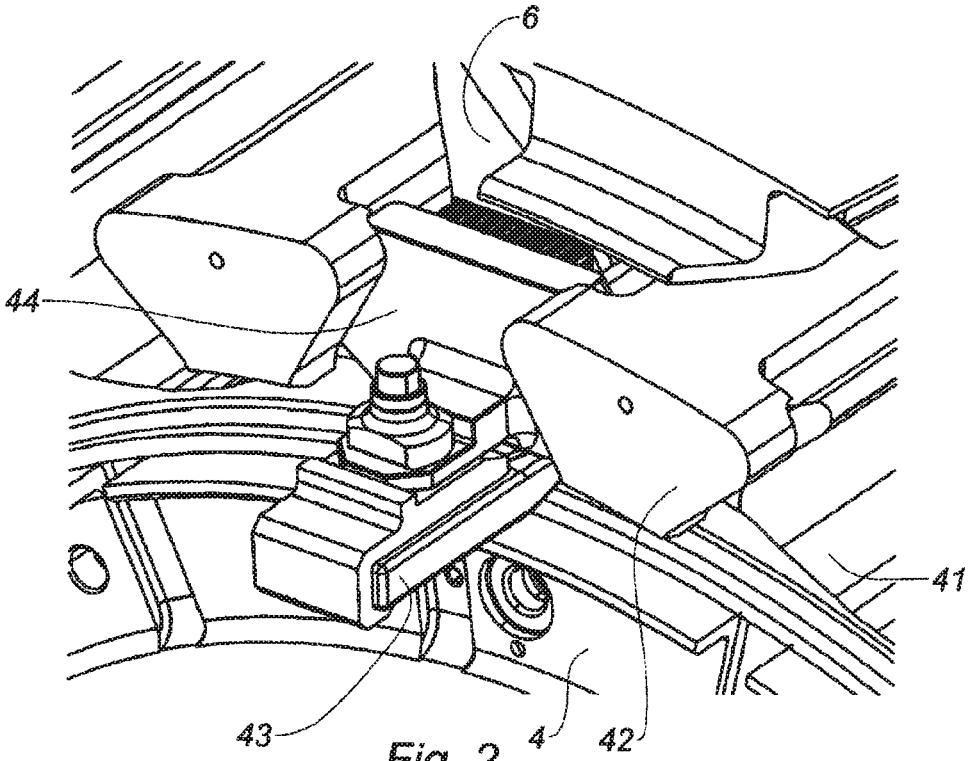
Fig. 2 Background Art
FIG. 2 is a perspective view of the connection between the axial wedge and the retaining lock of the blades of a fan rotor according to the prior art.
Figure 3:
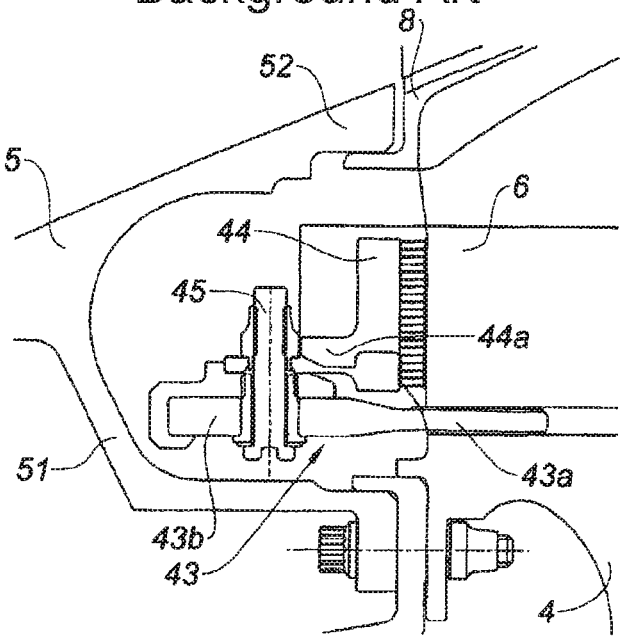
Fig. 3 Background Art
FIG. 3 is an axial section through a pocket showing the connection between the lock and the axial wedge of FIG. 2.

FIGS. 2 and 3 show the mounting of a fan blade 6 in a pocket 41 of the fan disk, according to the prior art. An axial wedge 43 is slipped under the root of the blade in order to keep the blade retained radially in its pocket and a lock 44 perpendicular to the wedge 43 is slipped into notches formed in the side walls of the pocket on the upstream side of the disk. The axial wedge comprises a part 43*a* which becomes lodged in the pocket and an upstream end lug 43*b* which protrudes beyond the disk 4 and serves to connect it to the lock 44. The connection is provided by a screw 45 which passes both through the lug 43*b* and through a lug 44*a* securely attached to the lock. This mounting both immobilizes the axial wedge 43 and the lock 44, all this immobilizing the blade in its pocket; the blade moreover being in axial abutment, at the downstream end, against the boost drum.

As can be seen in FIG. 3, this method of connection occupies a certain amount of space and interferes with the fitting of the cowl 5. The cowl 5 comprises a rib 51 with a radial flange by means of which it is fixed to the disk 4. The rear outer edge 52 axially blocks the inter-blade platforms 8 on the disk, these being retained radially in another fashion.

One embodiment of the wedge-lock assembly that allows a saving of space and makes for easier installation of an inter-blade platform retaining shell ring needed when these platforms are not made of metal and cannot be held in position using the means of the prior art, is now described.

Figure 4:
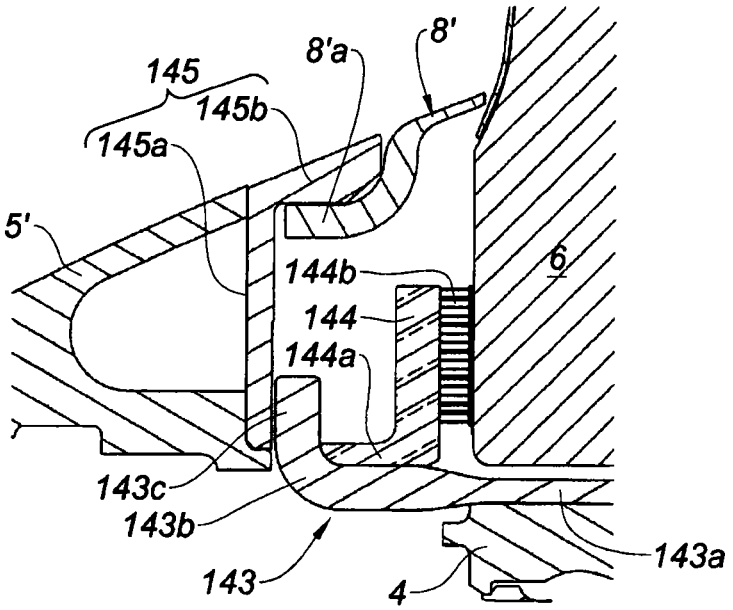
FIG. 4 is an axial section through a pocket showing the connection between an axial wedge and a lock according to a first embodiment of the invention.
Figure 5:
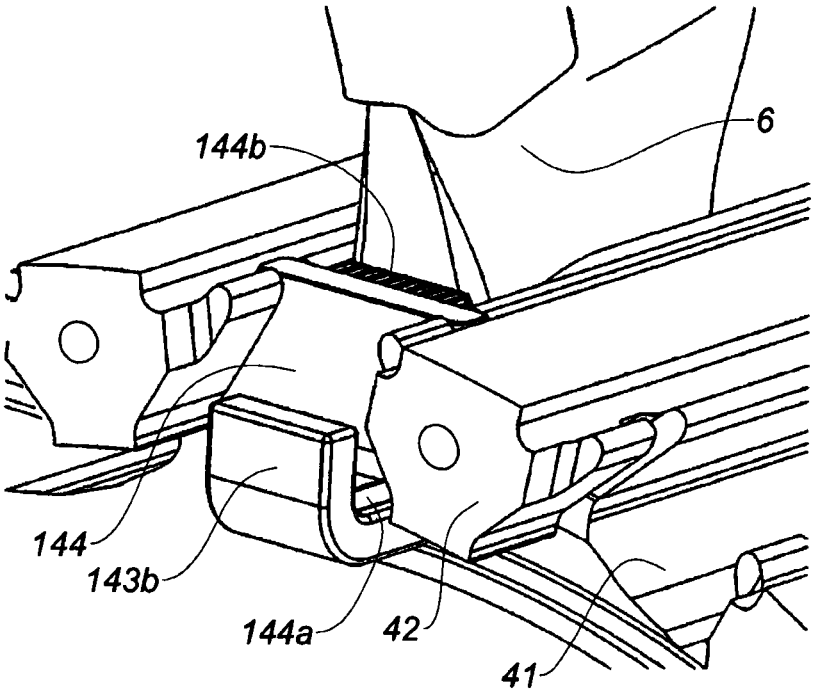
FIG. 5 shows the connection of FIG. 4 in isometric three-quarters perspective from the upstream end without the inter-blade platform retaining shell ring, these platforms themselves having not been depicted.

FIGS. 4 and 5 illustrate a first embodiment. The disk 4 and the blades are unchanged. An axial wedge 143 is slipped under the root of the blade 6 into the space available between the root of the blade and the bottom of the pocket. The wedge comprises an axial part 143*a* under the blade and a lug 143*b* which extends it in the upstream direction, a radial tab 143*c* terminates the lug at the upstream end and forms an axial abutment.

A transverse lock 144, in this instance perpendicular to the axial wedge, is slipped into notches formed in the side walls of the pocket. A lug 144*a* at right angles to the lock extends in the upstream direction until it comes into abutment against the radial tab 143*c* of the axial wedge 143. A honeycomb spacer piece 144*b* is interposed between the lock 44 and the root of the blade, according to a solution known per se from the prior art.

The inter-blade platforms 8' are held in place, retained against centrifugal forces, by a shell ring 145 which comprises an annular part 145*b* bearing against a corresponding wedging lug 8'*a*, formed on the inter-blade platforms 8'. The exterior surface of the annular part 145*b* of the shell ring 145 forms an aerodynamic surface that is continuous with the surface of the inter-blade platforms 8'. A radial flange 145*a* is pierced with orifices, not depicted, via which the shell ring is bolted to the frontal face of the teeth 42. This radial flange also forms an axial end stop for the tabs 143*c*.

On the upstream side of the shell ring 145, the cone 5' bears against the upstream face of this ring; it is fixed to the disk 4 by any appropriate means.

Putting the assembly together involves fitting the blades, locking them using the locks which are slipped into the radial notches, introducing the axial wedges 143 under the blades, possibly using a mallet because of the tight fit required. The tab 143*c* comes into abutment against the tab 144*a*. The lock 144 comprises lands collaborating with the notches for radial wedging when it presses on the wedge 143. The fitting of the annular shell ring 145 locks the assembly by coming to bear against the upstream face of the tab 143*c*.

Figure 6:
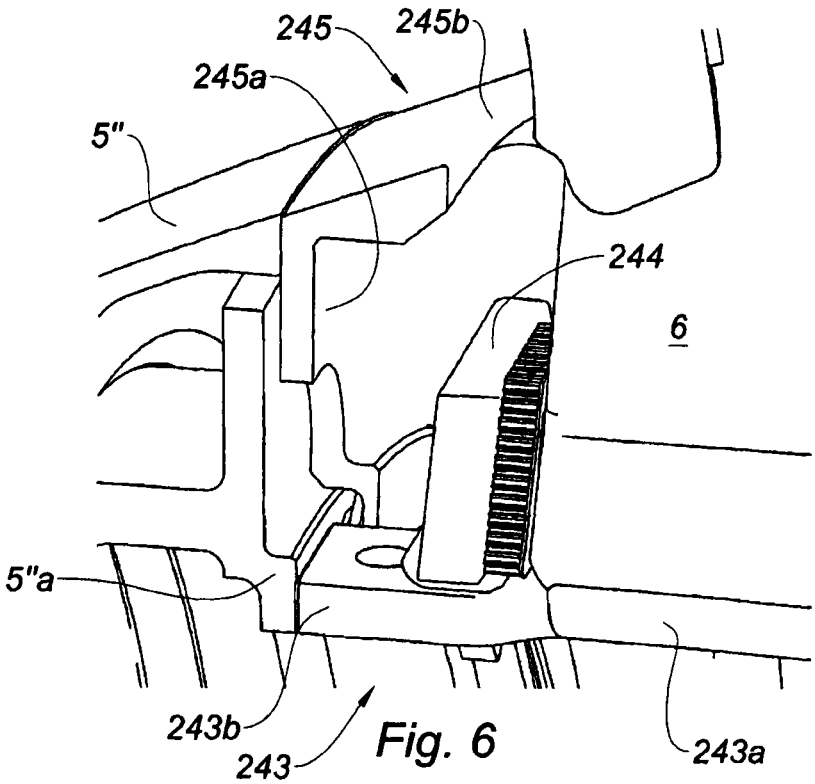
FIG. 6 is a perspective side view of a connection according to a second embodiment of the invention.
Figure 7:
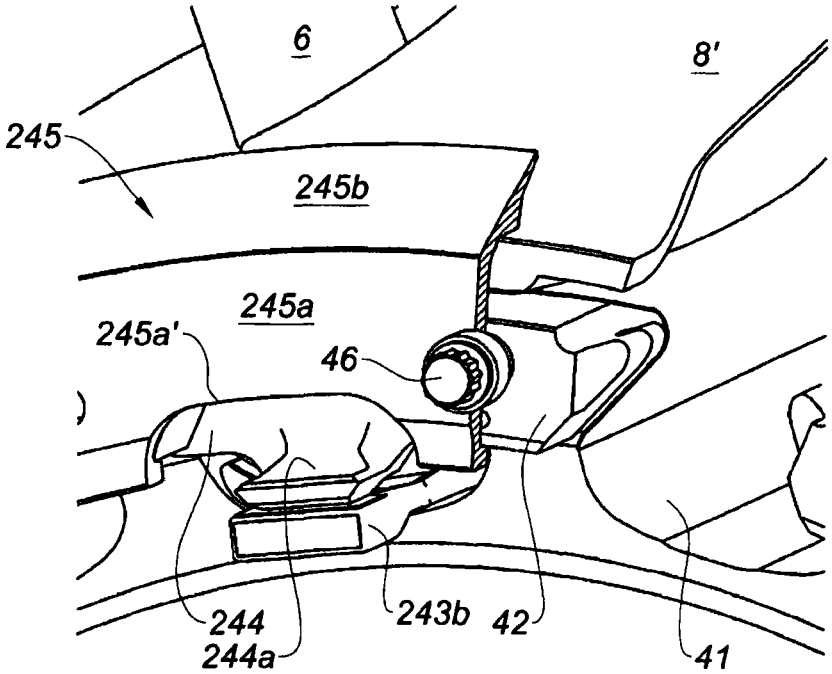
FIG. 7 is a three-quarters front perspective view of the rotor according to the second embodiment.

FIGS. 6 and 7 show an alternative form of the invention.

The axial wedge 243 comprises an axial part 243*a* which becomes positioned between the root of the blade and the bottom of the pocket, and an upstream tab 243*b* which in this instance is straight without a radial return. A lock 244 retains the blade axially like the previous lock 144; an annular shell ring 245 for the centrifugal retention of the inter-blade platforms comprises an annular part for bearing on upstream tabs formed on the inter-blade platforms. A radial flange 245*a* is bolted to the teeth of the rim of the disk 4 and holds the shell ring on the disk. This shell ring differs from the previous shell ring in that it does not perform the function of axially wedging the wedges 243. These wedges press axially against an axial rib secured to the cowl 5" through openings 245*a*' formed in the radial flange 245*a*. The axial bearing ribs 5"*a* secured to the cowl may be of a single piece therewith or alternatively may be added onto it.

On assembly, the blades 6 are placed in their respective pocket with the corresponding axial retention lock 244 then the axial wedges 243 are slipped in-between the blade roots and the bottoms of the pockets. The shell ring 245 is bolted 46 to the teeth of the rim. The openings 245*a*' keep the ends of the lugs 243*b* clear as can be seen in FIG. 7. Upon the fitting of the cowl 5" the rib 5"*a* comes to bear against the lug 243*b* which is therefore retained against any movement in the upstream direction when the engine is in operation.

On disassembly, an orifice formed in the lug allows the use of an extraction tool in the known way.

Either of the two embodiments allows axial wedges to be made from a composite material.

The invention claimed is:

1. A turbomachine rotor, comprising:

a disk with substantially axial pockets of dovetail cross section on a rim of the disk;

blades mounted individually in the pockets and inter-blade platforms mounted between the pockets;

an axial wedge arranged between a root of each of the blades and a bottom of each of the pockets; and a transverse lock providing upstream axial blockage of the blades in the respective pocket, the lock being guided in radial notches formed in side walls of the pockets and bearing radially against the wedge, wherein the axial wedge is immobilized in an upstream direction by being in abutment against a transverse annular component secured to the disk, said inter-blade platforms being held in place by an annular shell ring comprising a part against which a lug formed on said inter-blade platforms can rest, and wherein the axial wedge and the lock are free of a fastener connection between each other.

2. The rotor as claimed in claim 1, wherein the annular shell hug that holds said inter-blade platforms in place also forms said transverse annular component against which the axial wedges abut.

3. The rotor as claimed in claim 2, wherein the axial wedges comprise a radial tab forming an axial stop against said annular shell ring.

4. The rotor as claimed in claim 3, wherein the transverse lock comprises an axial lug forming an axial abutment for the axial wedge.

5. The rotor as claimed in claim 1, further comprising a spacer piece made of a material that can be deformed by compression between the lock and the blade root.

6. The rotor as claimed in claim 1, wherein said platforms are held in place by the annular shell ring, said annular component for the axial immobilization of the wedges forming part of a cone that protects an upstream side of the rotor.

7. The rotor as claimed in claim 1, wherein the annular shell ring comprises a radial flange for fixing to the disk, the radial flange being scalloped in order to form openings through which the axial wedges come to bear axially against the transverse annular component.

8. The rotor as claimed in claim 1, wherein the axial wedges comprise an axial lug with a radial orifice by which the axial wedges can be extracted from the respective pocket.

9. A turbofan engine, comprising:

the turbomachine rotor as claimed in claim 1.

* * * * *